US007415746B2

(12) United States Patent
Tao

(10) Patent No.: US 7,415,746 B2
(45) Date of Patent: Aug. 26, 2008

(54) METHOD FOR CONSTRUCTING A SELF ANCHORED SUSPENSION BRIDGE

(75) Inventor: Jian Ren Tao, Sunnyvale, CA (US)

(73) Assignee: SC Solutions, Sunnyvale, CA (US)

( * ) Notice: Subject to any disclaimer, the term of this patent is extended or adjusted under 35 U.S.C. 154(b) by 195 days.

(21) Appl. No.: 11/292,497

(22) Filed: Dec. 1, 2005

(65) Prior Publication Data

US 2007/0124876 A1 Jun. 7, 2007

(51) Int. Cl.
*E01D 21/00* (2006.01)

(52) U.S. Cl. ..... 14/77.1

(58) Field of Classification Search ..... 14/18, 14/21, 77.1

See application file for complete search history.

(56) References Cited

U.S. PATENT DOCUMENTS

| | | | | | |
|---|---|---|---|---|---|
| 1,592,685 | A | * | 7/1926 | Schachenmeier | 14/19 |
| 1,785,023 | A | * | 12/1930 | Edwards et al. | 14/23 |
| 2,878,498 | A | * | 3/1959 | Gollnow | 14/22 |
| 2,914,783 | A | * | 12/1959 | Hoyden et al. | 14/21 |
| 3,255,591 | A | * | 6/1966 | Thornley | 405/225 |
| 3,673,624 | A | | 7/1972 | Finsterwalder | |
| 3,685,074 | A | | 8/1972 | Marshall | |
| 3,738,112 | A | | 6/1973 | Grant | |
| 3,753,406 | A | | 8/1973 | Muller | |
| 3,794,433 | A | | 2/1974 | Shupack | |
| 3,808,624 | A | | 5/1974 | Barkdull, Jr. | |
| 3,857,130 | A | | 12/1974 | Sofronie | |
| 3,864,776 | A | | 2/1975 | Hedefine | |
| 3,906,687 | A | | 9/1975 | Schupack | |
| 4,223,495 | A | | 9/1980 | Peter | |
| 4,451,950 | A | | 6/1984 | Richardson | |
| 4,457,035 | A | | 7/1984 | Habegger | |
| 4,464,803 | A | | 8/1984 | Bonasso | |
| 4,484,425 | A | | 11/1984 | Muller | |
| 4,535,498 | A | | 8/1985 | Webster | |
| 4,581,860 | A | | 4/1986 | Berger | |
| 4,615,063 | A | | 10/1986 | Rolen | |
| 4,631,772 | A | | 12/1986 | Bonasso | |
| 4,641,816 | A | | 2/1987 | Kishida | |
| 4,644,978 | A | | 2/1987 | Bonasso | |
| 4,685,253 | A | | 8/1987 | Bitterly | |

(Continued)

*Primary Examiner*—Gary S Hartmann
(74) *Attorney, Agent, or Firm*—Michael A. Glenn; Glenn Patent Group

(57) ABSTRACT

A method for constructing a suspension bridge in places where it is not feasible to construct permanent earth anchorages land at either or both ends of the suspension bridge span is disclosed. The method of constructing the self-anchored suspension bridge comprises the use of preexisting permanent structures solely or in combination with minimum temporary structures to provide temporary anchor points for main suspension cables during construction. Once the suspension bridge span end structures are properly secured by a tensioning cable to the temporary structure or by a temporary connection to a permanent structure and the deck segment of pier table is lifted into place and tied down on an end support, the main suspension bridge cables are erected, suspenders are then erected from the main cable, and further construction of the bridge proceeds. Once the bridge deck segments are all erected and integrated with the end piers, temporary PT bars or cables connecting end supports to either preexisting or temporary structures are gradually released to transfer anchoring force back to the bridge deck. The temporary PT bars, cables and the temporary structures (if used) are then disassembled and removed.

2 Claims, 3 Drawing Sheets

U.S. PATENT DOCUMENTS

| | | | | | |
|---|---|---|---|---|---|
| 4,704,754 | A | | 11/1987 | Bonasso | |
| 4,884,377 | A | * | 12/1989 | Matt | 52/98 |
| 5,060,332 | A | | 10/1991 | Webster | |
| 5,070,566 | A | | 12/1991 | Lin | |
| 5,208,932 | A | | 5/1993 | Muller | |
| 5,493,746 | A | | 2/1996 | Minakami | |
| 5,513,408 | A | | 5/1996 | Minakami | |
| 5,539,946 | A | | 7/1996 | Kawada | |
| 5,615,436 | A | | 4/1997 | Brown | |
| 5,640,732 | A | | 6/1997 | Diana | |
| 5,655,244 | A | | 8/1997 | Minakami | |
| 5,784,739 | A | | 7/1998 | Kawada | |
| 5,896,609 | A | * | 4/1999 | Lin | 14/20 |
| 6,302,735 | B1 | | 10/2001 | Jartoux | |
| 6,523,207 | B1 | | 2/2003 | Stubler | |
| 6,681,431 | B2 | | 1/2004 | Zivanovic | |
| 6,715,176 | B2 | | 4/2004 | Stubler | |
| 6,728,987 | B1 | | 5/2004 | Hinman | |
| 6,817,444 | B1 | | 11/2004 | Shinas | |
| 6,832,459 | B2 | | 12/2004 | Russell | |

* cited by examiner

METHOD FOR CONSTRUCTING A SELF ANCHORED SUSPENSION BRIDGE

BACKGROUND OF THE INVENTION

1.Technical Field

The invention relates to bridges. More specifically, the invention relates to construction of a self-anchored suspension bridge.

2.Discussion of the Prior Art

Heretofore, most of the suspension bridges were constructed using earth anchors. In such cases, cables are anchored to earth at both sides of the span over which the bridge is built.

However, it may be desirable to build a suspension bridge based on considerations of esthetic preference or site conditions or both, for example, where the soil condition is not ideal for building earth anchorages economically, such as across the San Francisco-Oakland East Bay, it has been decided to provide a self-anchored suspension bridge for the navigation span of the New San Francisco-Oakland Bay Bridge East Span.

SUMMARY OF THE INVENTION

A method for constructing a self-anchored suspension bridge is disclosed. The method of constructing the self-anchored suspension bridge comprises the construction of a temporary structure, which is used to secure an end support of the suspension bridge by means of a cable therebetween. Another end support of the suspension bridge is preferably secured by a preexisting structure, but may also be secured by a temporary structure. Once the suspension bridge span end structures are properly secured by a tensioning cable to the temporary structure or by a temporary connection to a permanent structure, a pier table deck segment is lifted into place and tied down on an end support. After that, the main suspension bridge cables are erected, suspenders are erected from the main cable, and further construction of the bridge proceeds. Once the bridge is completed, the temporary structure is disassembled.

DETAILED DESCRIPTION OF A PREFERRED EMBODIMENT

The invention provides an alternative method of constructing a self-anchored suspension bridge.

Figure 1A:
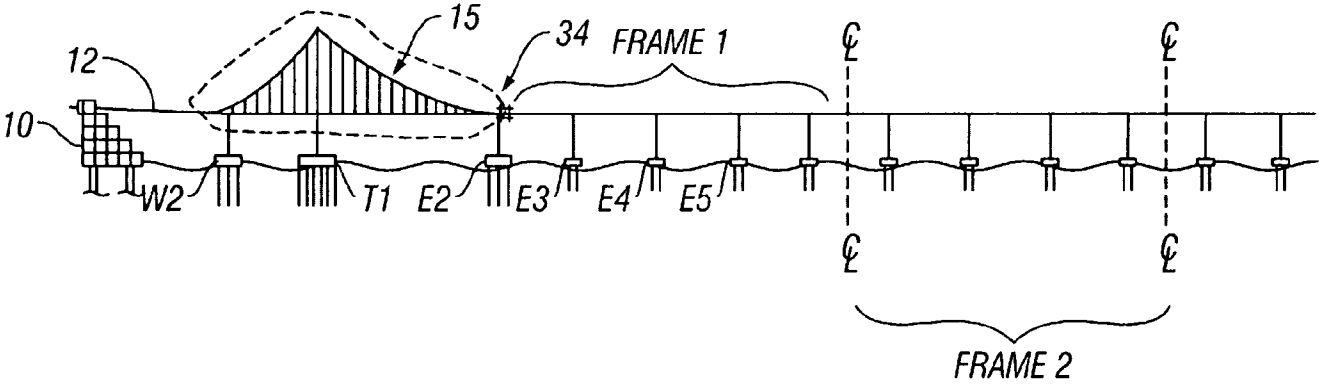
FIG. 1 is a schematic diagram showing a self-anchored suspension bridge according to the invention.
Figure 1B:
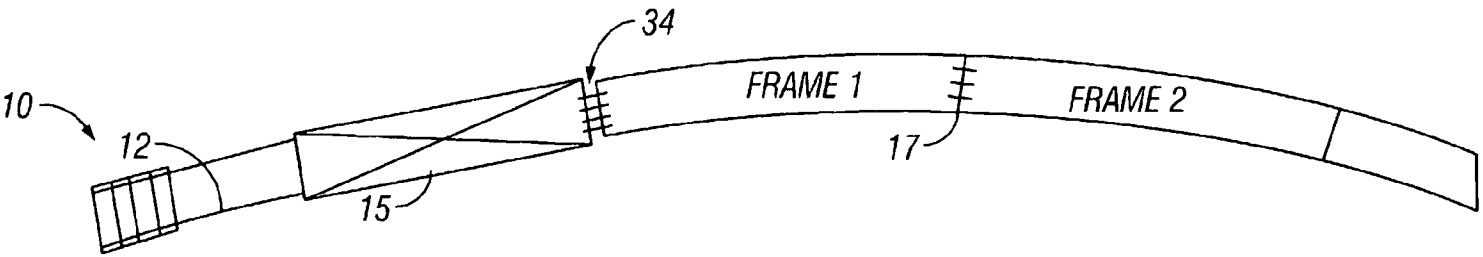

FIGS. 1A and 1B are schematic elevation and plan views of a self-anchored suspension bridge 15 according to the invention. A key problem with the construction of suspension bridges is the need to provide anchor points for the suspension bridge cables. Traditionally, these anchor point have been the earth anchorages and are located at both ends of the span across which the bridge is built. In the case of a self-anchored suspension bridge, such as the San Francisco-Oakland Self-Anchored Suspension Bay Bridge (Abbreviated as SAS thereafter), cables are supposedly anchored by the bridge deck carrying compressing force at both ends. Such self-anchor mechanism, however, does not exist until the bridge is fully assembled, because during construction, the bridge deck segments need to be supported by cables whereas not yet capable of providing the required anchor force for cables loaded by themselves. The broken chain needs to be connected by auxiliary structures. A straightforward solution is to construct a temporary bridge to support the bridge deck segments. Once the bridge segments are assembled and integrated with the end piers of the bridge, cables are erected and suspenders are installed. Then gravity force of the bridge deck is transferred onto cables by adjusting the suspenders' length and the temporary bridge is released and removed. However, in case where the bridge span is getting quite long over the deep water, such as SAS, constructing a temporary bridge itself become very challenging and too expensive. If there exist permanent structures can be utilized to provide all or part of the anchoring force for cables during construction, such costly temporary bridge can be avoided. As shown in FIGS. 1A and 1B that during construction, the main cable of a self-anchored suspension bridge 15 can be temporarily anchored by various means. On the left hand side of the bridge 15, cables are anchored at temporary structure 10 through temporary cables 12. It is relevant to point out that the foundation (footing and piles) of temporary structure 10 could be used afterwards to support a permanent approach bridge span. On the right hand side of the bridge 15 cables can be temporarily anchored using preexisting portions of the bridge, Frame 1. In case if Frame 1 alone is not sufficient, Frame 2 can be engaged using temporary connectors 17 to further provide required anchor force.

Figure 2A:
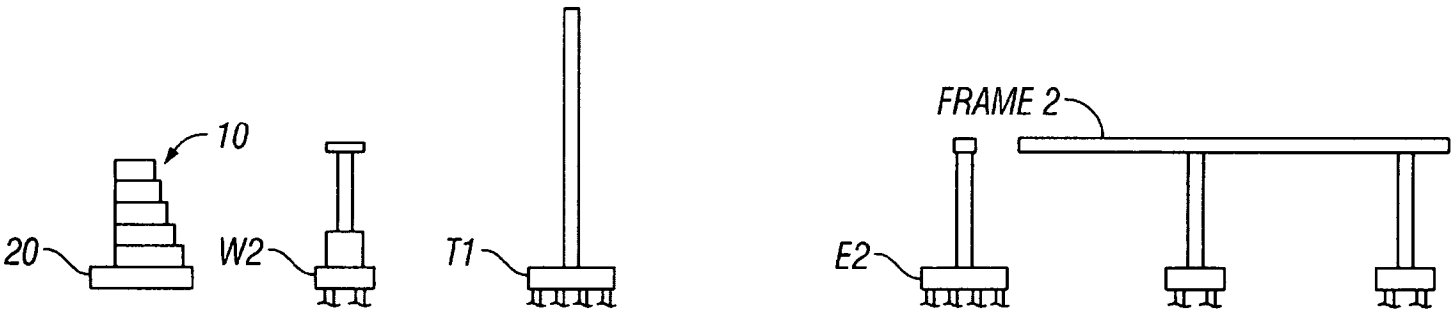
FIG. 2 shows a first step in the construction of a self-anchored suspension bridge according to the invention.
Figure 2B:
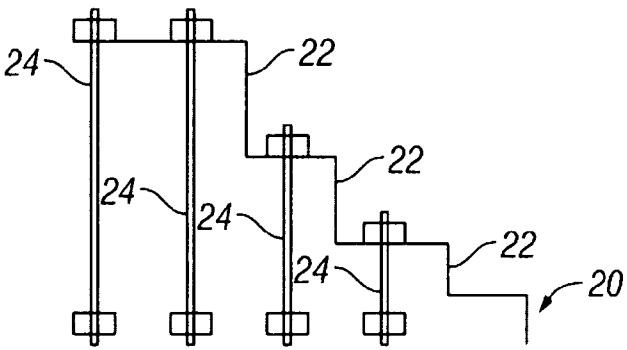

FIG. 2 shows a construction sequence beginning with a first step. In FIG. 2A, an elevation view is shown for the temporary structure as well as various bridge structures, i.e. end supports W2 and E2, and a center support T1. During construction, the end supports W2 and E2, as well as the center support T1 are built, including the pier tables for supports W2 and E2. The temporary structure 10 is also constructed as shown in FIG. 2B. To support t the temporary structure 10, a footing 20 is required. In some cases piles or rock sockets may be necessary to prevent the footing from sliding. The structure 20 could be utilized as the foundation for permanent approach bridge structures. The temporary structure 10 is preferably made of pre-cast concrete blocks 22 that have post-tensioning tendons there through and can be later easily dissembled and removed.

Figure 3:
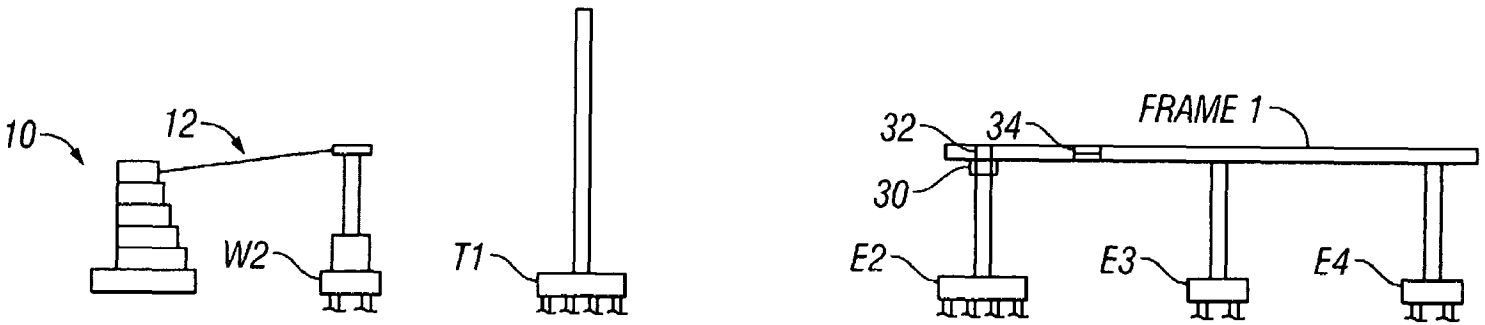
FIG. 3 shows a second step in the construction of a self-anchored suspension bridge according to the invention.

FIG. 3 shows a second step in the construction of the self-anchored suspension bridge. At a first part of step two, one deck segment 30 of the bridge is lifted onto end support E2 and is secured on support E2 via a tie down 32. The deck segment is connected with existing bridge structure Frame I using PT bars or cables 34, which can be initially tensioned, adjusted and released. If Frame 1 alone is not sufficient for providing the required anchoring force, the existing bridge structure Frame 2 can also be engaged by temporary connectors between Frame 1 and Frame 2. The cap beam of support W2 is tied with temporary structure 10 using PT bars or cables, and the cables are tensioned to the required initial forces.

Figure 4:
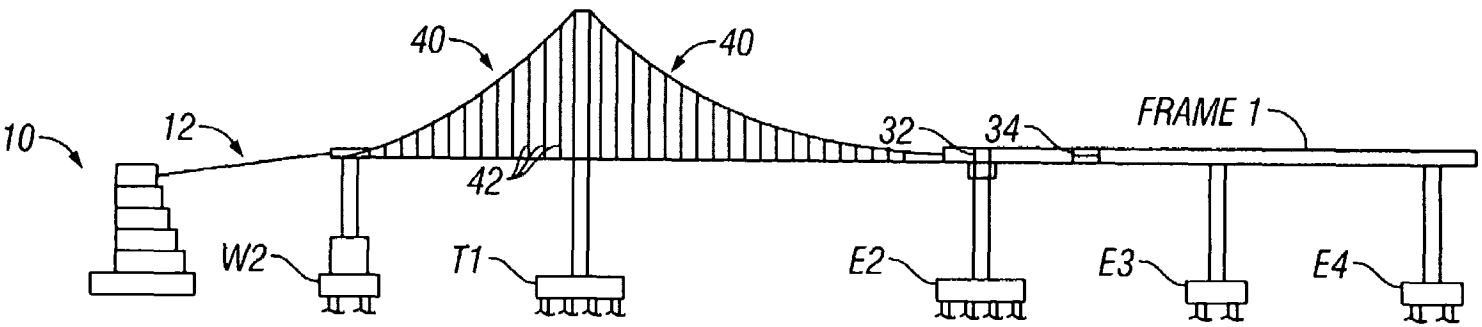
FIG. 4 shows a third step in the construction of a self-anchored suspension bridge according to the invention.

FIG. 4 shows a third step in constructing a self-anchored suspension bridge. The main suspension bridge cables 40 are erected.

The suspenders 42 are then erected onto the main cables. Add temporary hangers if crossbeams are welded after the erection of steel boxes (not shown).

During a fourth step, the box girder segments are lifted and the temporary PT bars or cables are adjusted as necessary. To avoid damage to the preexisting permanent structures, W2, E2, Frame I and Frame 2 (if engaged) have to be kept well within elastic condition. It is then necessary to align and make up box girder section splices, including crossbeams (if welded in field), and a closure segment at support W2. Once all segments are lifted and connected, the temporary PT bars at support structure E2 are gradually released from the support E2 frame I connection. Before doing this, the tie downs at support E2 are first released so that the box girder can slide longitudinally on temporary bearings. The temporary PT bars or cables are then released and the suspenders are adjusted to the required length.

At step five, the bridge furnitures are constructed and bridge construction is continued until the bridge is finished. Concurrently, the temporary structure is disassembled and the pre-cast concrete blocks are removed.

The above construction sequence has the advantages of eliminating construction of temporary towers, bridges, as would be used in making a suspension bridge that was self-anchored. This saves construction cost and time.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A method for constructing a self-anchored suspension bridge as part of a preexisting bridge, comprising the steps of:

erecting two end supports and a center support for said suspension bridge, an end support being erected on either side of said center support;

constructing a temporary structure founded on a foundation spaced away from, and proximate to, one end support of said suspension bridge;

tensioning said end support that is proximate to said temporary structure with a cable suspended therebetween;

forming temporary connections between another of said end support structures and said preexisting bridge;

erecting main suspension bridge cables;

erecting suspenders from said main cables;

lifting box girder segments and adjusting said temporary cables as necessary;

aligning and making up box girder section splices, including cross beams and a closure segment at an end support;

lifting a pier table deck segment of said suspension bridge onto one end support and securing said deck segment to said support;

connecting said deck segment with said preexisting bridge;

once all of said box girder segments, closure segments, and deck segments are lifted and connected, gradually releasing said temporary connections at said end support structure;

completing said bridge; and disassembling said temporary connections and said temporary structure.

2. The method of claim 1, said step of erecting suspenders further comprising the step of:

adding temporary hangers if cross beams are welded after erection of steel boxes.

* * * * *